US007955124B2

(12) United States Patent
Su et al.

(10) Patent No.: US 7,955,124 B2
(45) Date of Patent: Jun. 7, 2011

(54) CABLE CONNECTOR ASSEMBLY WITH AN EXTRA CONNECTOR TO SUPPLY POWER

(75) Inventors: Ping-Sheng Su, Tu-Cheng (TW); Jun Chen, Kunshan (CN); Feng-Jun Qi, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/635,720

(22) Filed: Dec. 11, 2009

(65) Prior Publication Data

US 2010/0151723 A1 Jun. 17, 2010

(30) Foreign Application Priority Data

Dec. 11, 2008 (CN) ..... 2008 2 0303305

(51) Int. Cl.
*H01R 11/00* (2006.01)

(52) U.S. Cl. ..... 439/505; 439/76.1; 439/620.22

(58) Field of Classification Search ..... 439/505, 439/76.1, 620.1, 620.22
See application file for complete search history.

(56) References Cited

U.S. PATENT DOCUMENTS

D535,623 S 1/2007 Hung-Way
7,387,529 B2 * 6/2008 Chan ..... 439/505
7,410,366 B2 * 8/2008 Wu ..... 439/76.1
7,413,471 B2 * 8/2008 Chan ..... 439/505
7,572,145 B1 * 8/2009 Wu ..... 439/607.02
7,628,619 B2 * 12/2009 Chuang ..... 439/76.1
7,780,458 B2 * 8/2010 Nagata et al. ..... 439/76.1
7,857,636 B2 * 12/2010 Su et al. ..... 439/76.1
2001/0023141 A1 * 9/2001 Chang ..... 439/76.1
2008/0176444 A1 * 7/2008 Chan et al. ..... 439/505
2009/0142959 A1 * 6/2009 Chuang ..... 439/620.01
2010/0151705 A1 * 6/2010 Su et al. ..... 439/67
2010/0151718 A1 * 6/2010 Li ..... 439/354
2010/0151723 A1 * 6/2010 Su et al. ..... 439/505
2010/0151731 A1 * 6/2010 Su et al. ..... 439/607.35
2010/0178794 A1 * 7/2010 Hsu ..... 439/391

* cited by examiner

*Primary Examiner* — Ross N Gushi

(74) *Attorney, Agent, or Firm* — Wei Te Chung; Andrew C. Cheng; Ming Chieh Chang

(57) ABSTRACT

A cable connector assembly includes a first cable connector (1), a pair of cables (4, 5), a second cable connector (2) and a third cable connector (3). The first cable connector has a printed circuit board (10) received therein, a shielding member (13) enclosing the printed circuit board and an insulative cover (14, 15) assembled out of the shielding member. The cables are connected with the printed circuit board and extending out of the shielding member, the second cable connector is in accordance with Displayport standard and connected with one of the two cables; and the third cable connector is in accordance with USB standard and connected with another one of the two cables.

9 Claims, 5 Drawing Sheets

CABLE CONNECTOR ASSEMBLY WITH AN EXTRA CONNECTOR TO SUPPLY POWER

BACKGROUND OF THE INVENTION

1. Field of the Invention

The present invention generally relates to a cable connector assembly, and more particularly to a cable connector assembly used for high definition signal transmission.

2. Description of Related Art

Nowadays, cable connector assemblies are widely used for connecting two electronic devices with different interfaces, U.S. Pat. No. D535,623S issued to Huang on Jan. 23, 2007 discloses a cable connector assembly, the cable connector assembly comprises a Digital Visual Interface (DVI) connector on one end and a High Definition Multimedia Interface (HDMI) connector on the other end. When a computer graphic card has a first connector in accordance with Displayport standard, and a Liquid Crystal Display (LCD) monitor has a second connector in accordance with DVI standard, similar cable connector assembly as aforementioned has a Displayport connector connected with the computer and a DVI connector connected with a monitor, the DVI connector includes a plurality of chips transmitting signal, and the chips need other extra components to supply power for thereof, however, the Displayport connector maybe not capable of affording enough power for the chips running.

Correspondingly, it is desired to have a cable connector assembly with improved shielding member to address the problems stated above.

BRIEF SUMMARY OF THE INVENTION

Accordingly, an object of the present invention is to provide a cable connector assembly having an extra connector to supply power for thereof.

In order to achieve the above-mentioned object, a cable connector assembly in accordance with the present invention comprises a first cable connector, a pair of cables, a second cable connector and a third cable connector. The first cable connector has a printed circuit board received therein, a shielding member enclosing the printed circuit board and an insulative cover assembled out of the shielding member. The cables are connected with the printed circuit board and extending out of the shielding member, the second cable connector is in accordance with Displayport standard and connected with one of the two cables; and the third cable connector is in accordance with USB standard and connected with another one of the two cables.

Other objects, advantages and novel features of the invention will become more apparent from the following detailed description of the present embodiment when taken in conjunction with the accompanying drawings.

DETAILED DESCRIPTION OF THE INVENTION

Figure 1:
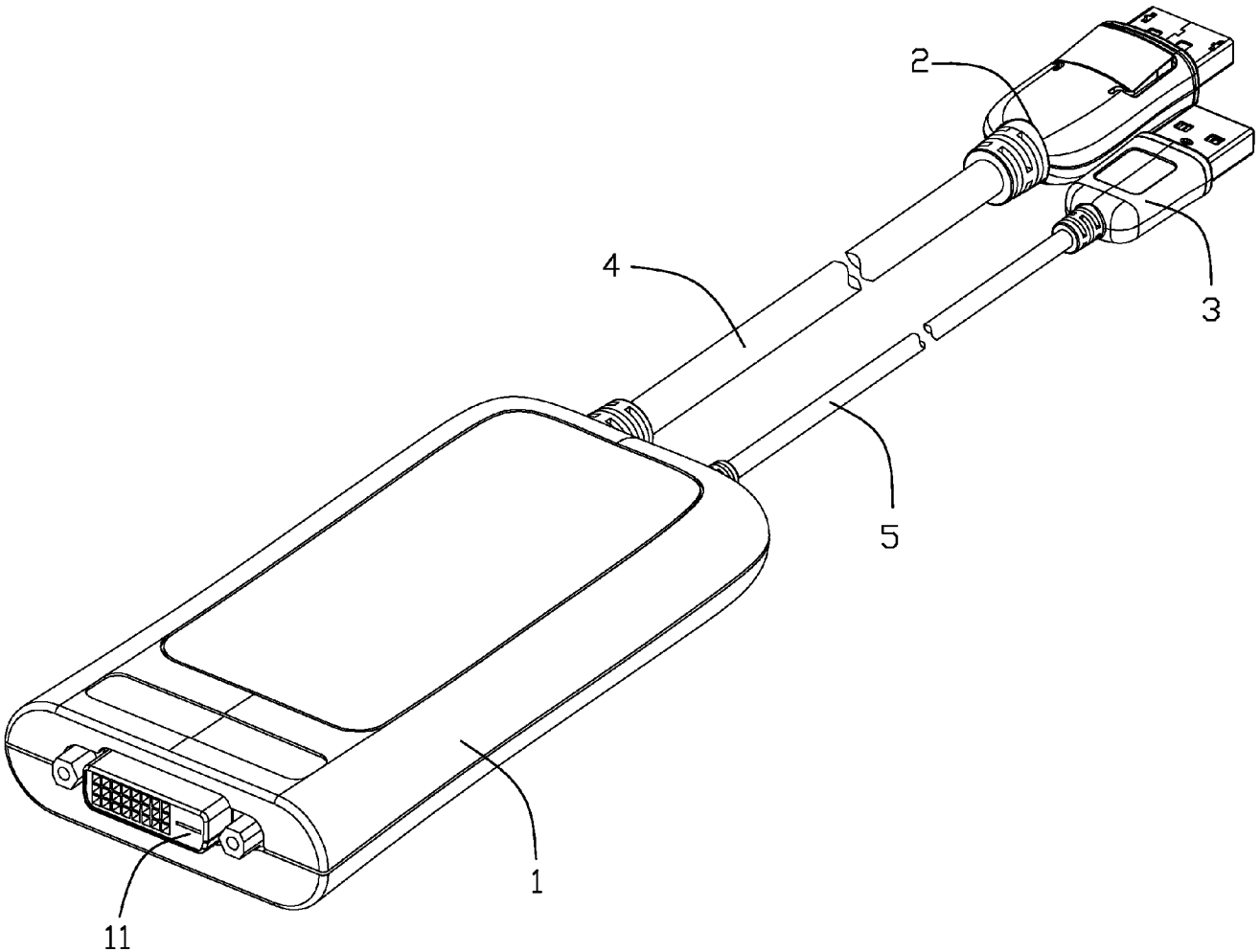
FIG. 1 is an assembled, perspective view of a cable connector assembly.

Reference will now be made to the drawing figures to describe the present invention in detail.

Figure 2:
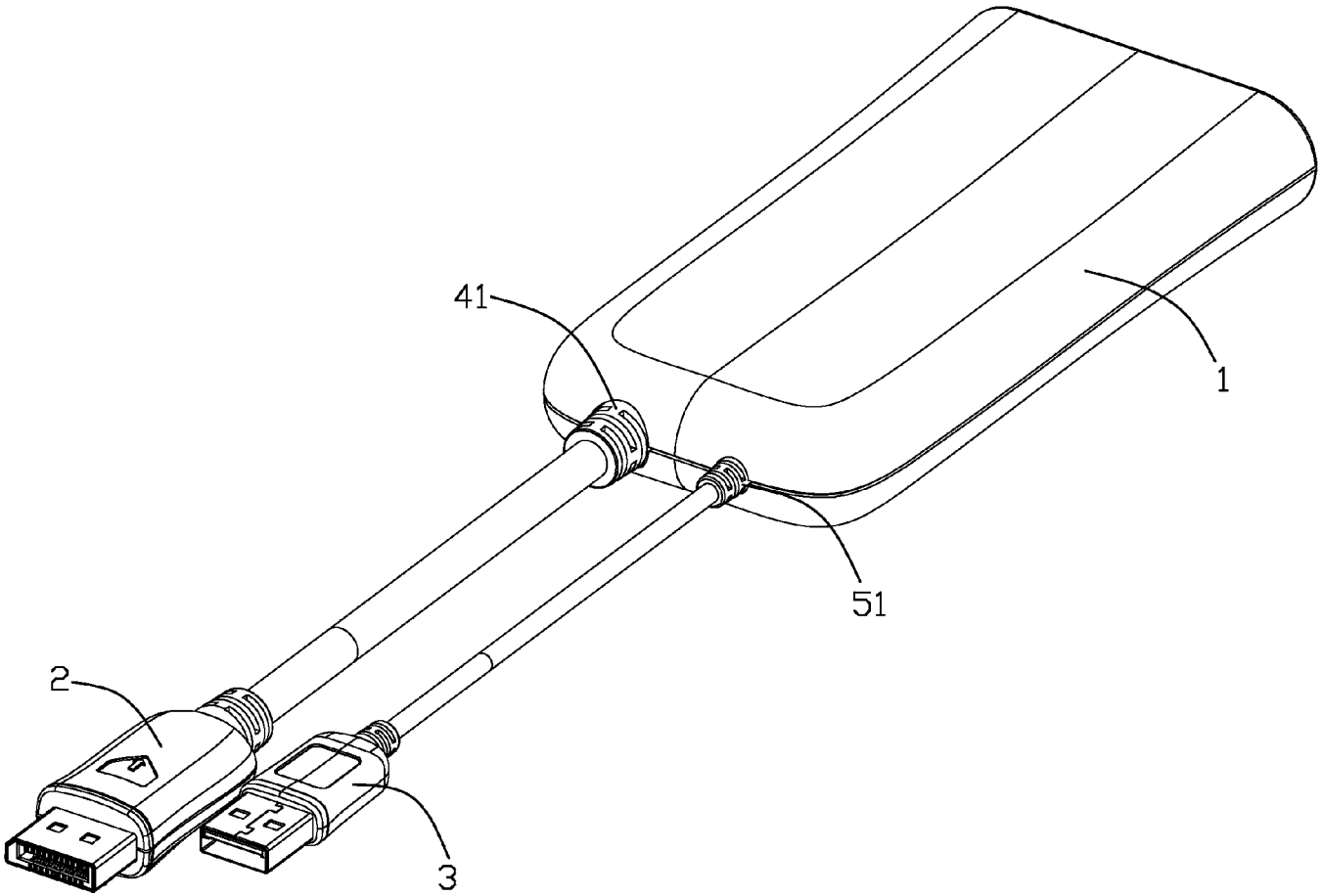
FIG. 2 is similar to FIG. 1, but viewed from another aspect.
Figure 3:
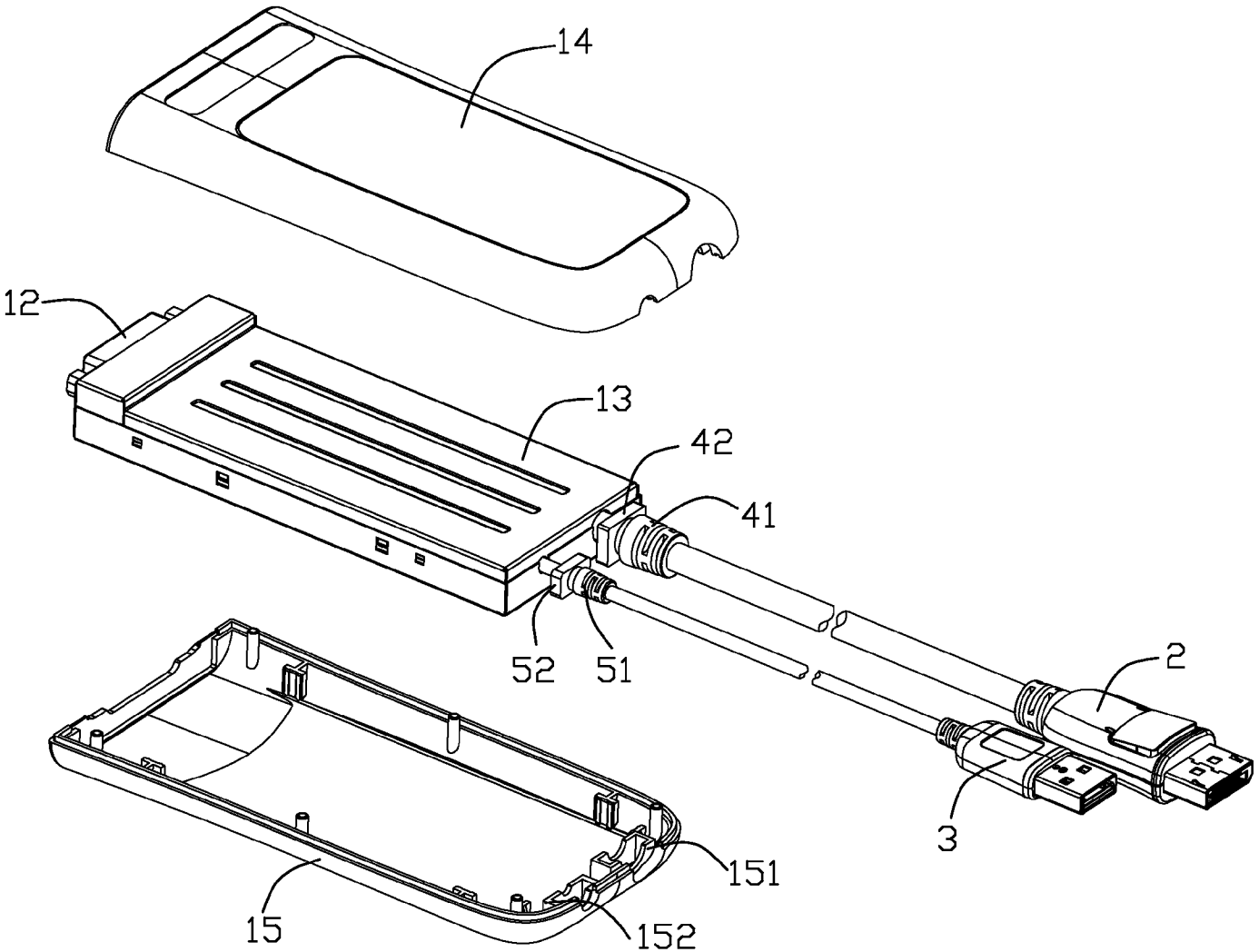
FIG. 3 is a partially exploded, perspective view of the cable connector assembly.

Referring to FIGS. 1-3, a cable connector assembly in accordance with the present invention comprises a first cable connector 1 compatible with Digital Visual Interface (DVI) transmitting protocol and a second cable connector 2 compatible with Displayport transmitting protocol, and the first cable connector 1 is connecting with the second cable connector 2. The cable connector assembly also comprises a third cable connector 3 connected with the first cable connector 1 and the second cable connector 2, a first cable 4 connected the first cable connector 1 and the second cable connector 2, and a second cable 5 connected the first cable connector 1 and the third cable connector 3.

Figure 4:
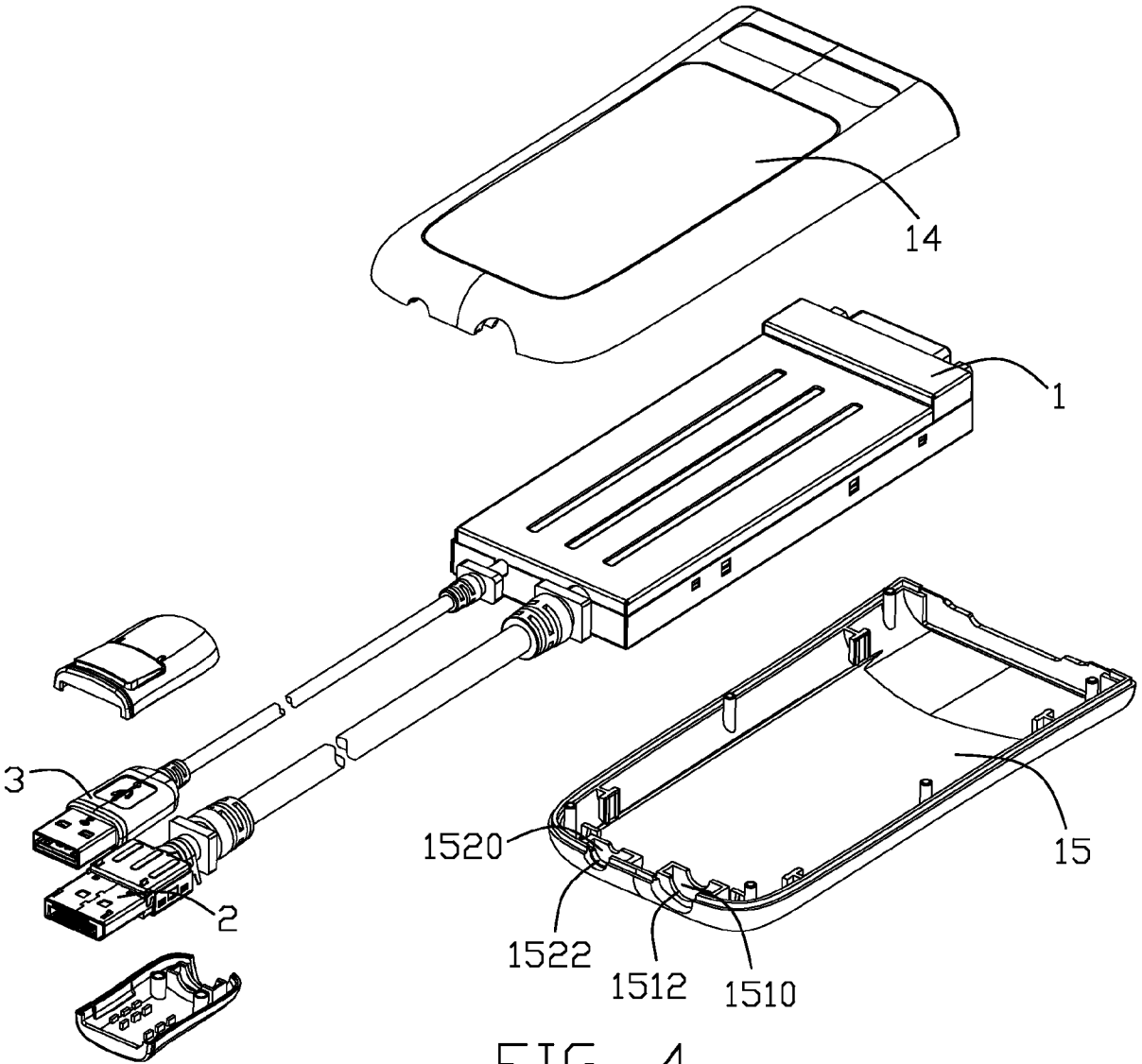
FIG. 4 is another partially exploded, perspective view of the cable connector assembly.
Figure 5:
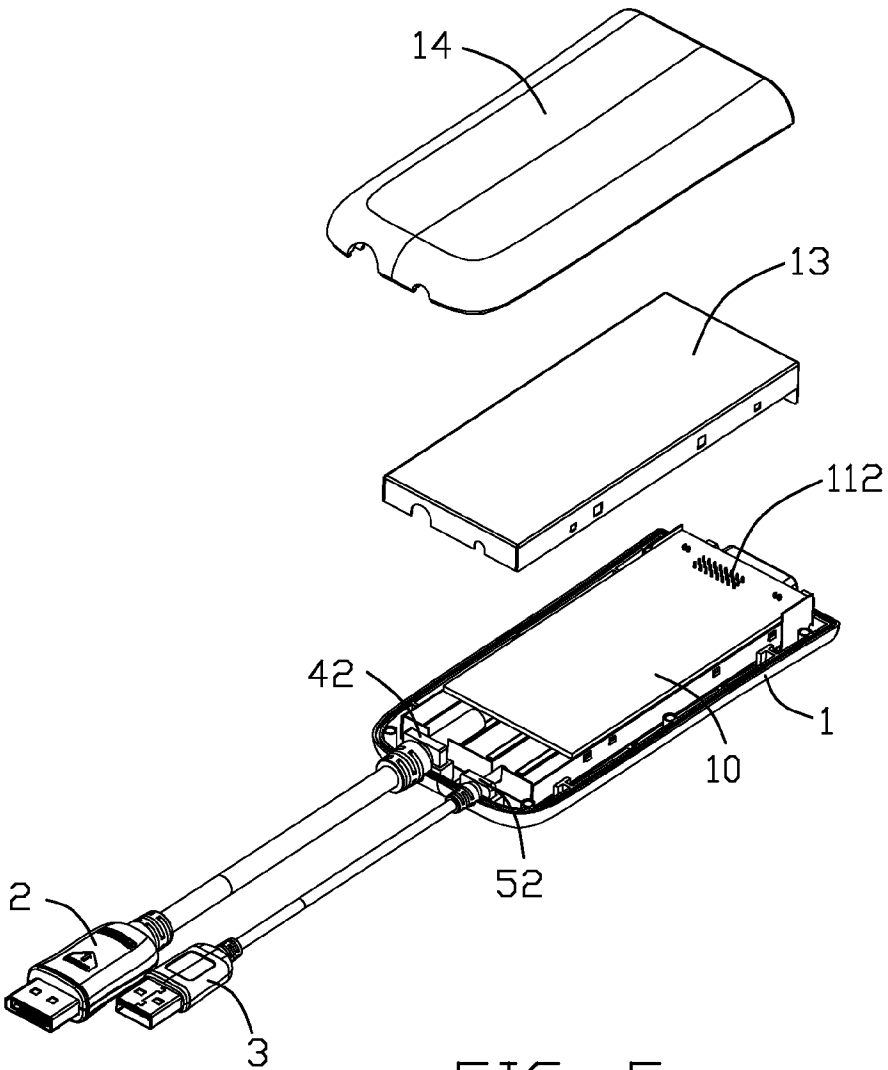
FIG. 5 is another partially exploded, perspective view of the cable connector assembly.

Referring to FIGS. 2-4, the cable connector assembly is used for high definition signal transmission, the first cable connector 1 is used for connecting with a Liquid Crystal Display (LCD) monitor, and the second connector 2 is used for connecting with a computer graphic card, the third cable connector 3 is connected with a USB receptacle connector on a computer to supply power required by the first cable connector 1 and the second cable connector 2.

The first cable connector 1 comprises a DVI connector in a front end thereof and a printed circuit board 10 connected with a back end of the DVI connector, and the DVI connector comprises an insulative housing 11 receiving a plurality of contacts 112 and a metallic shell 12 enclosing the insulative housing 11, the printed circuit board 10 is connected with the contacts 112 and defines a group of chips (not shown) thereon. The first cable 4 and the second cable 5 are connected with the printed circuit board 10, another end of the first cable 4 is connected with the second cable connector 2, and another end of the second cable 5 is connected with the third cable connector 3. A shielding member 13 is enclosing on the printed circuit board 10 of the first cable connector 1, both the first cable 4 and the second cable 5 are extending out of the shielding member 13.

The first cable connector 1 also comprises a top cover 14 and a bottom cover 15 enclosing the shielding member 13 in the embodiment in accordance with the present invention, the top cover 14 and the bottom cover 15 are made of insulative material and have the same shape with each other. The bottom cover 15 defines a first retaining portion 151 and a second retaining portion 152 on a back end thereof, and the first retaining portion 151 has the same shape with the second retaining portion 152 but is larger than the second retaining portion 152. The first retaining portion 151 is recessed downwards to form a retaining channel 1510 in a middle portion thereof and an arc-shape receiving slot 1512 in a top surface thereof. The second retaining portion 152 also has a retaining channel 1520 and an arc-shape receiving slot 1522. The first cable 4 and the second cable 5 define strain relief portions 41, 51 and engaging portions 42, 52 in front of the strain relief portions 41, 51 respectively, the engaging portions 42, 52 are retained in the retaining channels 1510, 1520 of the first and the second retaining portions 151, 152, the strain relief portions 41, 51 are supported in the receiving slots 1512, 1522 of the first and the second retaining portions 151, 152.

As the second cable connector 2 could not supply enough power for driving the chips of the first cable connector 1 to transmit signal, the third cable connector 3 is a USB connector and capable of supplying power for the first cable connector 1, therefore the cable connector assembly can work normally.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a first cable connector having a printed circuit board received therein, a shielding member enclosing the printed circuit board and an insulative cover assembled outside of the shielding member;

a pair of cables connected with the printed circuit board and extending out of the shielding member;

a second cable connector in accordance with Displayport standard connected with one of the two cables; and a third cable connector in accordance with USB standard connected with another one of the two cables.

2. The cable connector assembly as claimed in claim 1, wherein the third cable connector is used for supply power.

3. The cable connector assembly as claimed in claim 2, wherein the first cable connector has a DVI connector located on a front segment of the printed circuit board.

4. The cable connector assembly as claimed in claim 3, wherein the insulative cover defines a pair of retaining portions on a back end thereof.

5. The cable connector assembly as claimed in claim 4, wherein the pair of the retaining portions have the same configurations with each other, and the one retaining portion engaging with the cable connected with the second cable connector is larger than the other retaining portion engaging with another cable connected with the third cable connector.

6. The cable connector assembly as claimed in claim 4, wherein each retaining portion is recessed downwards to form a retaining channel in a middle portion thereof and an arc-shape receiving slot in a top surface thereof.

7. The cable connector assembly as claimed in claim 6, wherein each cable defines an engaging portion retained in the retaining channel of the retaining portion.

8. A cable connector assembly comprising:

two wires commonly defining opposite first and second ends thereof;

a large connector located at the first end and connected to both said two wires via a printed circuit board;

first and second small connectors located the second end and directly connected to corresponding wires, respectively; wherein the first connector is a DisplayPort connector and the second connector is a USB connector.

9. The cable connector assembly as claimed in claim 8, wherein said large connector is a DVI connector.

* * * * *